US006536785B2

(12) United States Patent
Lee

(10) Patent No.: US 6,536,785 B2
(45) Date of Patent: Mar. 25, 2003

(54) ROLLER SKATE SHOES

(76) Inventor: Billy Lee, 6th Fl., No. 76, Tun Hua South Road, Sec. 2, Taipei (TW)

( * ) Notice: Subject to any disclaimer, the term of this patent is extended or adjusted under 35 U.S.C. 154(b) by 0 days.

(21) Appl. No.: 09/797,768

(22) Filed: Mar. 1, 2001

(65) Prior Publication Data

US 2002/0121749 A1 Sep. 5, 2002

(51) Int. Cl.[7] ..... A63C 17/00

(52) U.S. Cl. ..... 280/11.27; 280/7.13; 280/841; 280/11.19; 36/115

(58) Field of Search ..... 250/11.25, 11.27, 250/11.223, 11.221, 11.232, 11.233, 841, 11.19, 7.13, 11.26, 43.24; 36/114, 115, 116, 25 R, 132

(56) References Cited

U.S. PATENT DOCUMENTS 3,884,485 A * 5/1975 Walle ..... 280/11.1
3,979,842 A * 9/1976 Texidor ..... 36/115
5,785,327 A * 7/1998 Gallant ..... 280/11.27
6,120,039 A * 9/2000 Clementi ..... 280/11.19
6,247,708 B1 * 6/2001 Hsu ..... 280/11.223
6,308,964 B1 * 10/2001 Chang ..... 280/11.19
6,328,318 B1 * 12/2001 Hsu ..... 280/11.223
6,336,644 B1 * 1/2002 Chu ..... 280/11.233
6,343,800 B2 * 2/2002 Clementi ..... 280/11.233
6,364,322 B1 * 4/2002 Lee ..... 280/11.27
6,386,555 B1 * 5/2002 Kao ..... 280/7.13
2001/0022433 A1 * 9/2001 Chang ..... 280/11.19

* cited by examiner

*Primary Examiner*—Brian L. Johnson
*Assistant Examiner*—J. Allen Shriver
(74) *Attorney, Agent, or Firm*—Raymond Y. Chan; David and Raymond

(57) ABSTRACT

A roller skate shoe includes a shoe base having two receiving cavities provided thereunder at a front portion and a rear portion of the shoe base respectively, a roller arrangement fittedly received in each receiving cavity including a supporting frame securely mounted on a ceiling of the receiving cavity having a supporting member extended downwardly, a T-shaped wheel frame including a vertical wheel arm rotatably mounted on the supporting member and a horizontal wheel axle for rotatably supporting two wheels at two ends thereof, and a resilient element for applying an urging pressure against the wheel frame so as to normally retain the wheel frame slid out of the receiving cavity, and a locker means for securely locking the wheel frame in a rotatably movable manner selectively between a folded position and an unfolded position.

13 Claims, 6 Drawing Sheets

ROLLER SKATE SHOES

BACKGROUND OF THE PRESENT INVENTION

1. Field of Invention

The present invention relates to roller skate shoes, and more particularly to a pair of roller skate shoes each comprising two foldable roller arrangements wherein each foldable roller arrangement is adapted for substantially supporting a pair of wheels thereon in a stable manner.

2. Description of Related Arts

Nowadays, roller skates are well known and have been considered as a formed of transportation, recreation, and exercise. Conventional roller skates each comprises a roller device permanently installed thereunder such that a player must carry an extra pair of shoe for interchange purpose, which is a hassle for the player.

As shown in FIG. 1, an improved pair of roller skate shoes is adapted for solving the above problem. Each roller skate shoe comprises a base 1A having two chambers 10A provided thereon and two roller devices 2A foldably received in the chambers 10A respectively in such a manner that the roller device 2A is folded into the chamber 10A for storage and unfolded out of the chamber 10A for usage. So, the player does not have to carry an extra pair of shoes everywhere. Each roller device 2A comprises an U-shaped supporting frame 21A under the base 1A of the roller skate shoe within the chamber 10A comprising a shaft 211A transversely mounted on the supporting frame 21A, and an U-shaped wheel frame 22A rotatably mounted on the shaft 211A comprising a wheel axle 221A transversely mounted on the wheel frame 22A wherein a wheel 222A is rotatably supported on the wheel axle 221A in such a manner that the wheel frame 22A is adapted for rotatably folding in the chamber 10A for storage purpose and rotatably folding out of the chamber 10A for use.

Such roller skate shoe further comprises locking means 23A mounted on the shaft 211A of the supporting frame 21A for locking the wheel frame 22A in position. The locking means 23A comprises a locker arm 231A slidably mounted on the shaft 211A of the supporting frame 21A wherein the locker arm 231A has a locking tip 2311A for blocking a rotational movement of the wheel frame 22A by the supporting frame 21A, and a compression spring 24A, which is coaxially mounted on the shaft 211A, having two ends biasing against the locker arm 231A and the wheel frame 22A for urging and retain the locker arm 231A in a locking position. In order to use the roller skate shoe, the player must use his or hand to pull the wheel frame 22A out of the chamber 10A in a rotatably movable manner until the locking tip 2311A of the locker arm 231A slid out of the supporting frame 21A so as to lock up the wheel frame 22A in position. For unlocking the wheel frame 22A, the player must use his or her hand again to push the locker arm 231A aside until the locking tip 2311A is moved away from the supporting frame 21A and then push the wheel frame 22A back into the chamber 10A.

While the foregoing disclosure of the conventional roller skate shoes, the shoes have several drawbacks. Each roller device 2A must have a relative larger size in order to rigidly support a downward force which is the weight of the player. In other words, the roller device 2A requires a bigger chamber 10A, especially the depth thereof, to fittedly store the roller device 2A therein such that the shoe must be increase its size and weight, which is an unreasonable afford for the player especially for a young child.

Thus, since the contacting area of the shoe is between the wheel 222A and the ground, the size of the wheel 222A is a main factor for stable manner. However, the wheel frame 22A can only carry one wheel 222A such that when a bigger wheel 222A is used, the size of the wheel frame 22A must be bigger than the size of the wheel 222A, Which will create the storage drawback as mentioned above. When a smaller wheel 222A is used, the young player may easily lose his or her balance so as to cause an unwanted injury to the young player. In fact, the U-shaped wheel frame 22A cannot provide a rigid structure for the wheel 222A supporting thereon so that the wheel frame 22A may be easily broken when an external force, such as a collusion force, exerted on the wheel frame 22A and cause major injury to the young player.

Moreover, the locking means 23A cannot securely hold the wheel frame 22A in order to prevent an unwanted rotational movement thereof. Since a coil spring 25A is used for retaining the wheel frame 22A rotatably sliding out of the chamber 10A, the locker arm 231A is also forced to push of the supporting frame 21A to lock up the wheel frame 22A as well. So, the wheel frame 22A may only be blocked to slide back to the chamber 10A until the locker arm 231A hits the supporting frame 21A such that an unwanted rotational movement of the wheel frame 22A will cause an unbalance of the roller skate shoe. Also, in the locked position, the locker arm 231A must be strong enough to bias against the rotating force of the wheel frame 22A. It is worth to mention that the rotating force will proportionally increase when the radially distance from the center is increased. In other words, the longer length of the locker arm 231A is, the greater rotational force of the locker arm 231A must be afforded. So, the locker arm 231A must be rigid enough to lock up the rotation of the wheel frame 22A.

Furthermore, the player must use his or her hand to pull out the wheel frame 22A and unlock the wheel frame 22A every time for use and storage respectively. It is a hassle for the player because the player must touch the wheel 222A even though the wheel 222A is dirty. Also, some players may have difficulties to bend down their body to fold and unfold the roller device 2A due to their physical abilities. They may merely take off their shoes to operate the folding and unfolding process. It is unreasonable that they have to take off their shoes every time, which is the same as the conventional roller skates.

SUMMARY OF THE PRESENT INVENTION

A main object of the present invention is to provide roller skate shoes wherein each roller arrangement of the roller skate shoes comprises a pair of wheels rigidly supported on a wheel axle for increasing a contacting area between the wheels and the ground so as to provide a stable manner for a player.

Another object of the present invention is to provide roller skate shoes wherein each roller arrangement has relative small size and shape so as to reduce the size and weight of the shoe, which can also minimize the cost of the shoe as well.

Another object of the present invention is to provide roller skate shoes which comprises a locking means for locking up a wheel frame in position wherein an operation button is provided on an outer surface of the shoe for unlocking the wheel frame. In other words, the player does not require his or her hands to touch the wheels in order to unlock the wheel frame.

Another object of the present invention is to provide roller skate shoes wherein the locking means locks up the wheel axle by means of engagement so as to minimize the rotational force exerted on the locking means. In other words, the locking means can securely lock up the roller device in position.

Accordingly, in order to accomplish the above objects, the present invention provides roller skate shoes, each comprising:

a shoe base having two receiving cavities provided thereunder at a front portion and a rear portion of the shoe base respectively;

a roller arrangement fittedly received in each receiving cavity comprising:

a supporting frame securely mounted on a ceiling of the receiving cavity comprising a supporting member extended downwardly;

a T-shaped wheel frame comprising a vertical wheel arm rotatably mounted on the supporting member of the supporting frame by a shaft and a horizontal wheel axle for rotatably supporting two wheels at two ends thereof; and a resilient element which is disposed in the wheel frame for applying an urging pressure against the wheel frame so as to normally retain the wheel frame slid out of the receiving cavity; and a locker means for securely locking the wheel frame in a rotatably movable manner selectively between a folded position and an unfolded position wherein in the folded position, the wheel frame is rotatably slid into the receiving cavity and in the unfolded position, the wheel frame is rotatably slid out of the receiving cavity.

DETAILED DESCRIPTION OF THE PREFERRED EMBODIMENT

Figure 1:
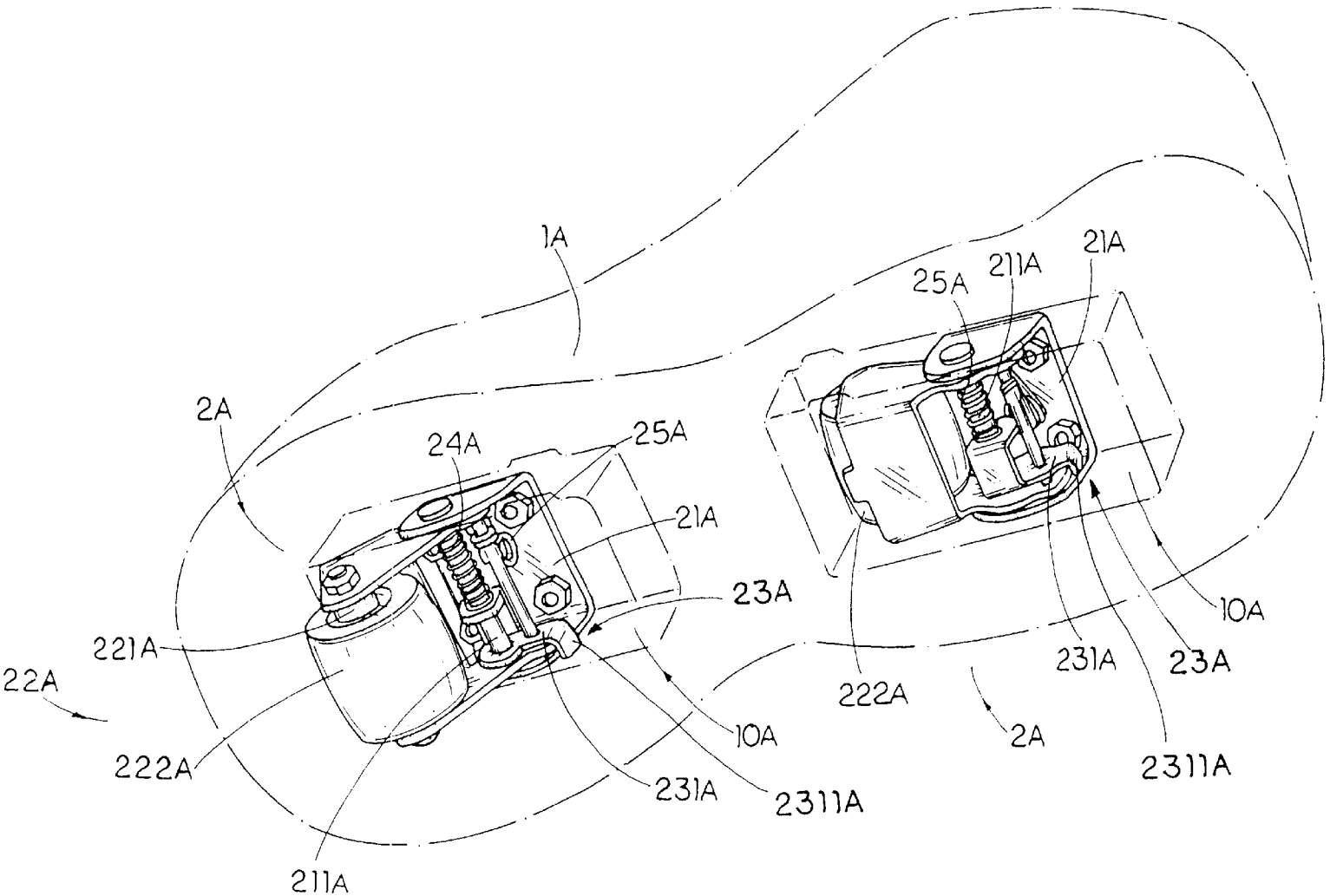
FIG 1 PRIOR ART
FIG. 1 is a perspective view of a conventional roller skate shoe.
Figure 2:
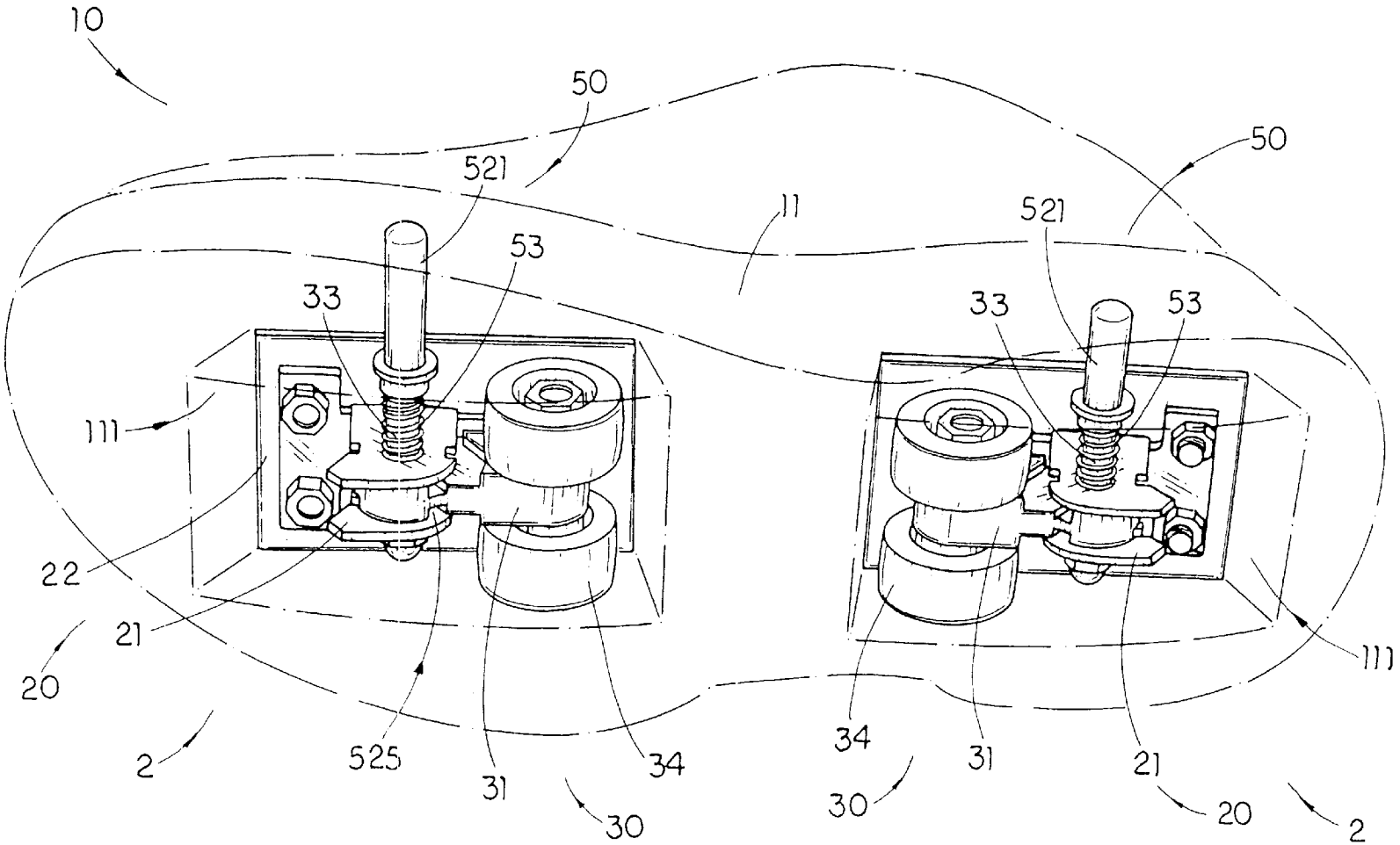
FIG. 2 is a perspective view of a roller skate shoe according to a preferred embodiment of the present invention.

Referring to FIG. 2 of the drawings, a roller skate shoe 10 according to a preferred embodiment of the present invention is illustrated. The roller skate shoe 10 comprises a shoe base 11 having two receiving cavities 111 provided thereunder at a front portion and a rear portion of the shoe base 11 respectively and a roller arrangement 2 fittedly received in each receiving cavity 111 of the shoe base 10.

Figure 3:
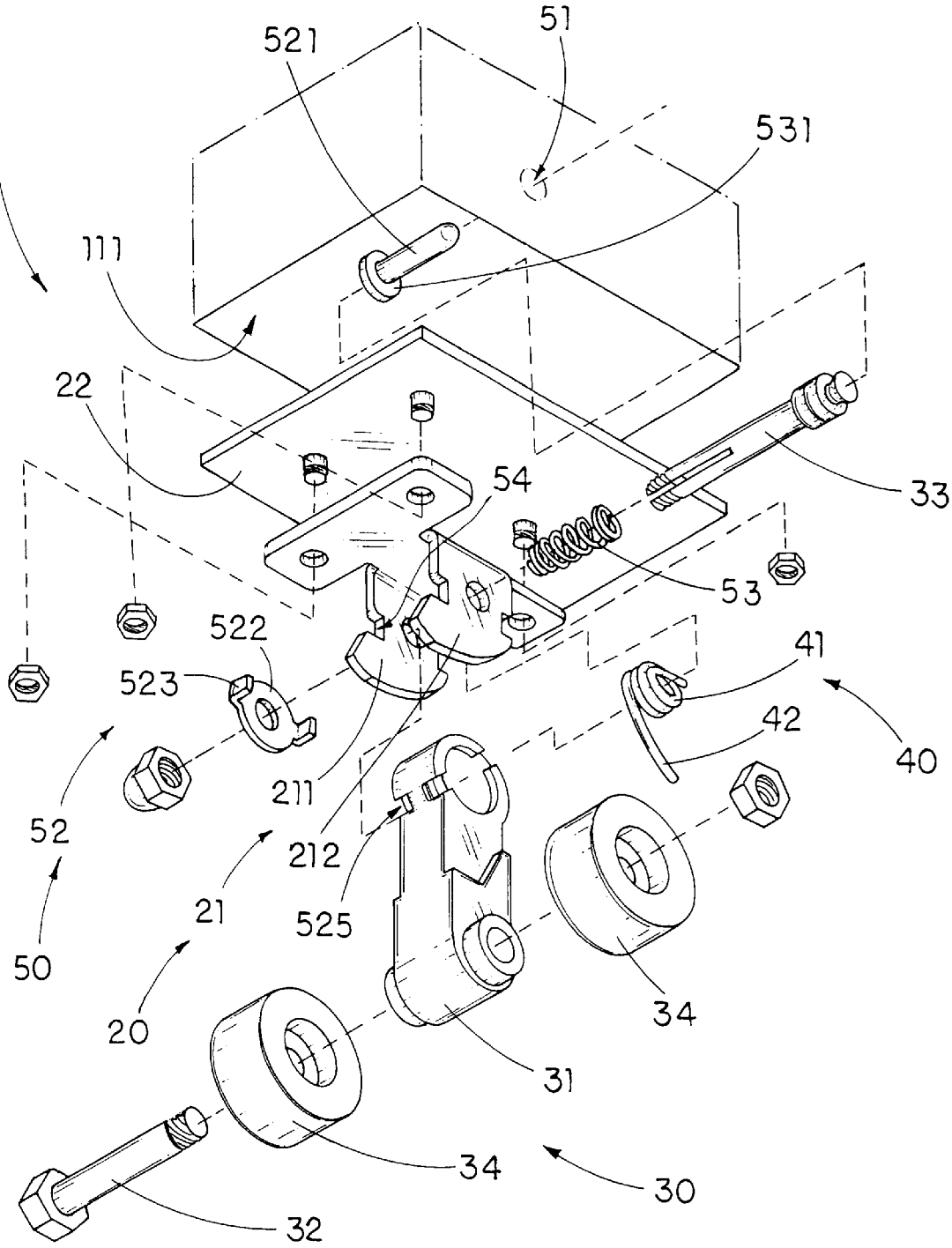
FIG. 3 is an exploded perspective view of a roller arrangement of the roller skate shoe according to the above preferred embodiment of the present invention.

As shown in FIG. 3, the roller arrangement 2 comprises a supporting frame 20 securely mounted on a ceiling of the receiving cavity 111 comprising a supporting member 21 extended downwardly, a T-shaped wheel frame 30 comprising a vertical wheel arm 31 rotatably mounted on the supporting member 21 of the supporting frame 20 by a shaft 33 and a horizontal wheel axle 32 for rotatably supporting two wheels 34 at two ends thereof, and a resilient element 40 which is disposed in the wheel frame 30 for applying an urging pressure against the wheel frame 30 so as to normally retain the wheel frame 30 out of the receiving cavity 111 of the shoe base 11.

Figure 6:
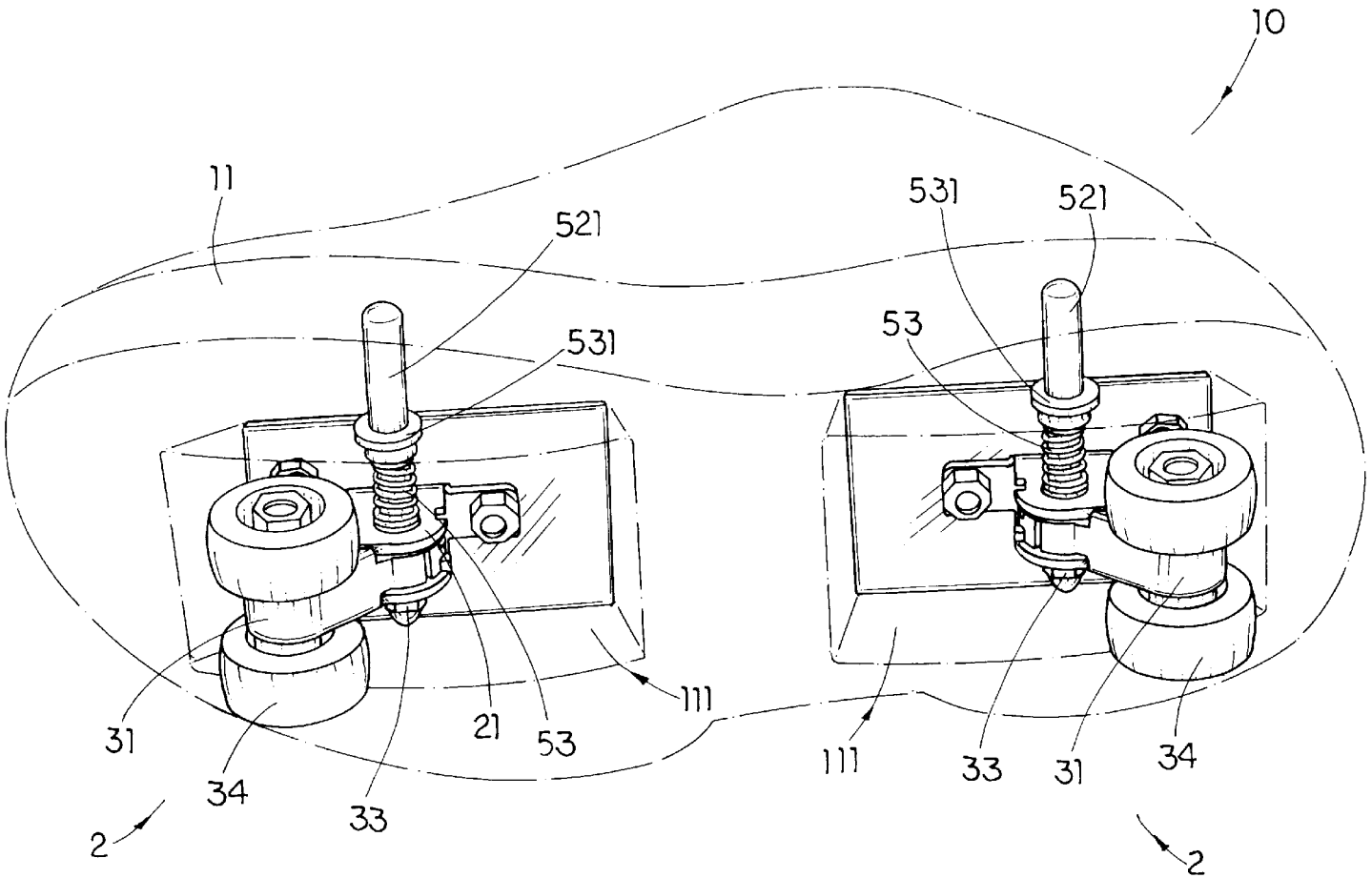
FIG. 6 is a perspective view of the roller skate shoe according to the above preferred embodiment of the present invention, illustrating the wheel frame being folded out of the receiving cavity.

The roller skate shoe 10 further comprises a locker means 50 for securely locking the wheel frame 30 in a rotatably movable manner selectively between a folded position and an unfolded position wherein in the folded position as shown in FIG. 2, the wheel frame 30 is rotatably slid into the receiving cavity 111 and in the unfolded position as shown in FIG. 6, the wheel frame 30 is rotatably slid out of the receiving cavity 111 of the shoe base 11.

According to the preferred embodiment, the shoe base 11 of the roller skate shoe 10 has a predetermined shape and thickness such that the receiving cavity 111 has a predetermined depth adapted for fittedly receiving the roller arrangement 2 therein. It is worth to mention that when the wheel frame 30 is foldably received in the receiving cavity 111, the roller skate shoe 10 becomes a regular sport shoe and when the wheel frame 30 is foldably rotated out of the receiving cavity 111, the wheels 34 are rotatably exposed under the roller skate shoe 10 and function as a conventional roller skate.

The supporting frame 20 further comprises a rigid supporting panel 22 firmly mounted on the ceiling of the receiving cavity 111 of shoe base 10 so as to reinforce the shape of the receiving cavity 111 wherein the supporting member 21 is securely affixed to the supporting panel 22. Accordingly, the supporting member 21 comprises a pair of parallel supporting walls 211, 212 downwardly extended from the supporting panel 22.

The wheel arm 31 of the wheel frame 30 is rotatably mounted between the two supporting walls 211, 212 of the supporting member 21 by the shaft 33 in such manner that the wheel frame 30 is adapted for freely rotating from the receiving chamber to outside. The two wheels 34 are rotatably mounted on two outer ends of the wheel axle 32. Accordingly, the construction of the wheel frame 30 is rigid enough to support the wheels 34 thereon when a downward force which is the weight of the player is exerted on the entire roller skate shoe 10, such as the construction of the wheel assembly of the airplane.

The resilient element 40, according to the preferred embodiment, is a coil spring disposed in the wheel frame 30 for normally retaining and urging the wheel frame 30 in the unfolded position wherein the resilient element 40 has a coil body 41 coaxially affixed to the shaft 33 and at least one resilient arm 42 extended from the coil body 41 for biasing against the wheel arm 31. The resilient arm 42 of the resilient element 40 applies an urging force against the wheel frame 31 to push it outwardly until the wheel frame 30 is rotatably slid out of the receiving cavity 111, which is the unfolded position of the wheel frame 30.

The locker means 50 has an operation through slot 51 provided on a sidewall of the receiving cavity 111 to communicate with an exterior of the shoe base 10, a locking member 52 for selectively engaging with the wheel arm 31 from being slid rotatably with respect to the supporting member 21, and a resilient member 53 for applying an urging pressure against the locking member 52 so as to retain the locking member 52 in a locking position.

According to the preferred embodiment, the operation through slot 51 is transversely formed on an inner sidewall of the receiving cavity 111 wherein the operation through slot 51 is coaxially aligning with the shaft 33 of the wheel frame 30.

The locking member 52 is movably attached to a side of the wheel frame 30 so as to lock up the wheel frame 30 on the supporting frame 20 in a rotatably movable manner, wherein the locking member 52 comprises an operation button 521 extended to the operation through slot 51 for operating the locking member 52 to move from a normally locking position to an unlocked position.

Figure 4:
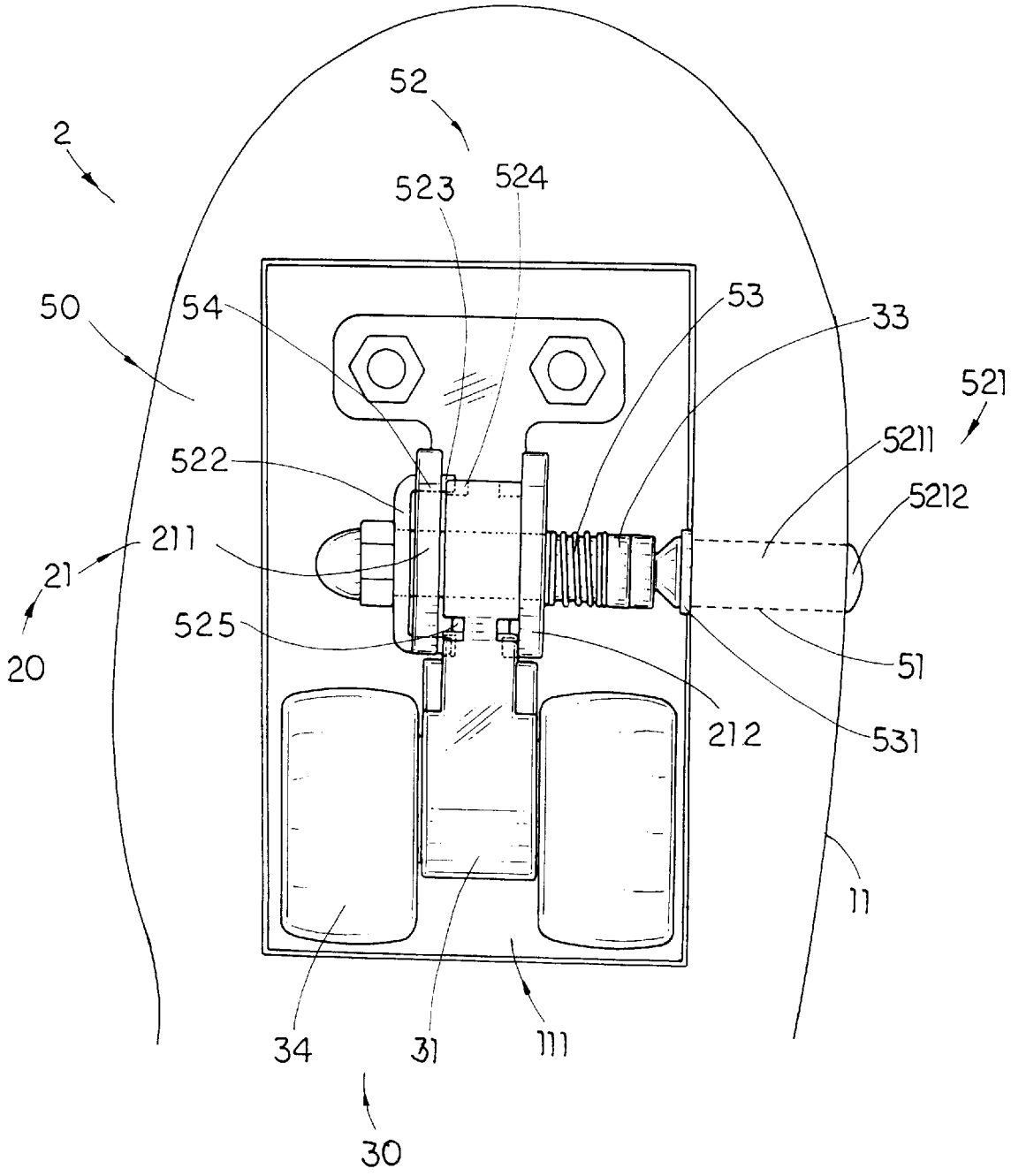
FIG. 4 is a side view of a locker means of the roller skate shoe in a locked position according to the above preferred embodiment of the present invention.
Figure 5:
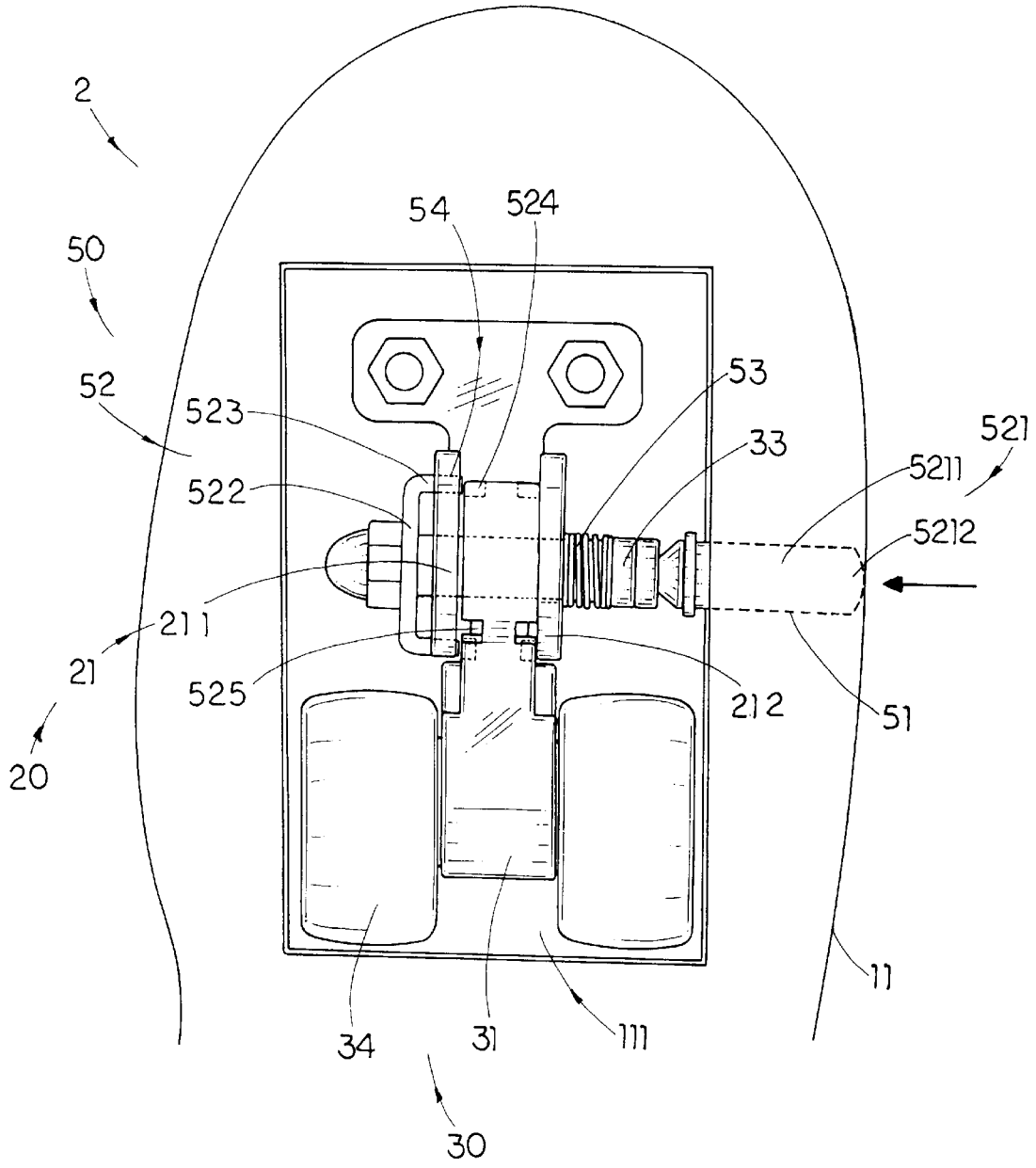
FIG. 5 is a side view of the locker means of the roller skate shoe in an unlocked position according to the above preferred embodiment of the present invention.

Accordingly, in the locking position as shown in FIG. 4, the wheel frame 30 is locked for rotational movement by the engagement between the locking member 52 and the wheel frame 30 so as to lock up the wheel frame 30 on the supporting frame 20. In the unlocked position as shown in FIG. 5, the locking member 52 is moved to release the engagement between the locking member 52 and the wheel frame 30 so that the wheel frame 30 is capably of rotatably sliding into the receiving cavity 111, i.e. the folded position of the wheel frame 30, and out of the receiving cavity 111, i.e. the unfolded position of the wheel frame 30.

The locking member 52 further comprises a locker cap 522 having at least a locking flange 523 integrally therefrom wherein the locker cap 522 is coaxially attached to an outer end of the shaft 33 and positioned adjacent to the respective supporting wall 211. Two locker grooves 524, 525 are transversely formed on the wheel arm 31 respectively wherein the locking flange 523 is engaged with one of the locker grooves 524 in the folded position of the wheel frame 30 while the locking flange 523 is engaged with another locker groove 525 in the unfolded position of the wheel frame 30. In other words, the wheel frame 30 is locked up by the engagement between the locking flange 523 and the locker grooves 524, 525 in both folded and unfolded positions, so as to prevent an unwanted rotational movement of the wheel frame 30.

The operation button 521 comprises an elongated button body 5211 outwardly extended from an inner end of the shaft 33 to the exterior of the shoe base 11 through the operation through slot 51 in a slidably movable manner and an enlarged button head 5212 provided on an inner side of an outer surface of the shoe base 11 in such a manner that when the button head 5212 of the operation button 521 is pressed in an inward manner, the locking flange 523 of the locker cap 522 is disengaged with the respective locker groove 524, 525 so as to unlock the rotational movement of the wheel frame 30.

The resilient member 53, which is a compression spring, is coaxially mounted on the button body 5211 of the operation button 521 wherein the resilient element 53 has one end biasing against the respective supporting wall 212 and the other end connected with a spring stopper 531 for biasing against the sidewall of the receiving cavity 111. The resilient member 53 normally applies an urging force against the operation button 521 to push it to the exterior of the shoe base 11 through the operation through slot 51 until the spring stopper 531 is stopped by the sidewall of the receiving cavity 111, wherein the locker cap 522 is pulled towards to the wheel frame 30 to engage the locking flange 523 with the respective locker groove 524, 525 and maintain in such a locking position that substantially blocks the rotational movement of the wheel frame 30.

It is worth to mention that the locker means 50 locks up the wheel frame 30 from the shaft 33 so as to minimize the rotational locking force exerted on the locker means 50, so that the locker means 50 can securely lock up the rotational movement of the wheel frame 30.

The locker means 50 further has a guiding slot 54 provided on the respective supporting wall 211 of the supporting member 21 of the supporting frame 20 wherein the locking flange 523 is fitted in the guiding slot 54 so as to hold the locker cap 522 in position.

In order to unlock the roller skate shoe 10, an inward pushing force must be intentionally pressed on the button head 5212 of the operation button 521, so that the locker cap 522 is driven to move away from the wheel arm 31 through the shaft 33, so as to disengage the locking flange 523 with the respective locker groove 524. Then, the wheel frame 30 is automatically slid out of the receiving cavity 111 by the compressed resilient element 40 in a rotatably movable manner. While the pushing force is released, the compressed resilient member 53 will be rebounded to its original form which pushes the locker cap 522 back to its original locking position so that the locking flange 523 will then be engaged with the respective locker groove 525 to lock up the wheel frame 30 in the unfolded position.

For folding the wheel frame 30, the player simply applies the inward pushing force again on the operation button 521 to disengage the locking flange 523 of the locker cap 522 with the respective locker groove 524 and then rotatably press the wheel frame 30 back into the receiving cavity 111 until the locking flange 523 re-engaging with the respective locker groove 525 so as to lock up the wheel frame 30 in the folded position. It is worth to mention that since the player wears the roller skate shoe 10, the player can simply press down the roller skate shoe 10 in order to press the wheel frame 30 back into the receiving cavity 111 with respect to the ground. So, the player does not have to take off the roller skate shoe 10 in order to unfold the wheel frame 30 out of the receiving cavity 111 for use and fold the wheel frame 30 into the receiving cavity 111 for storage. Thus, in both locking and unlocking processes of the roller skate shoe 10, the player simply presses the operation button 521 to operate the roller skate shoe 10, so that the player does not require to use his or her hand in order to touch the wheel frame 30 at all.

What is claimed is:

1. A roller skate shoe, comprises:

a shoe base having two receiving cavities provided thereunder at a front portion and a rear portion of said shoe base respectively;

two roller arrangements, which are fittedly received in said receiving cavities respectively, each comprising:

a supporting frame securely mounted on a ceiling of said receiving cavity comprising a supporting member extended downwardly;

a T-shaped wheel frame comprising a vertical wheel arm rotatably mounted on said supporting member of said supporting frame by a shaft and a horizontal wheel axle for rotatably supporting two wheels at two ends thereof; and a resilient element which is disposed in said wheel frame for applying an urging pressure against said wheel frame so as to normally retain said wheel frame slid out of the receiving cavity; and a locker means for securely locking said wheel frame in a rotatably movable manner selectively between a folded position and an unfolded position wherein in said folded position, said wheel frame is rotatably slid into said receiving cavity and in said unfolded position, said wheel frame is rotatably slid out of said receiving cavity, wherein said locker means has an operation through slot provided on a sidewall of said receiving cavity to communicate with an exterior of said shoe base, a locking member for selectively engaging with said wheel arm from being slid rotatably with respect to said supporting member, and a resilient member for applying an urging pressure against said locking member so as to retain said locking member engaging with said wheel arm, wherein said locking member comprises a locker cap coaxially attached to an outer end of said shaft and positioned adjacent to said respective supporting member wherein said locker cap comprises at least a locking flange integrally therefrom for selectively engaging with two locker grooves transversely formed on said wheel arm respectively, and an operation button extended to said operation through slot for operating said locker cap to move from a normally locking position to an unlocked position, wherein in said locking position, said locking flange is engaged with said locker grooves in said folded and unfolded positions of said wheel frame respectively, and in said unlocked position, said locking flange is disengaged with said locker groove so that said wheel frame is capably of rotatably sliding with respect to said supporting frame.

2. A roller skate shoe, as recited in claim 1, wherein said operation button comprises an elongated button body outwardly extended from an inner end of said shaft to said exterior of said shoe base through said operation through slot in slidably movable manner and an enlarged button head provided on an outer surface of said shoe base in such a manner that when said button head of said operation button is pressed in an inward manner, said locking flange of said locker cap is disengaged with said respective locker groove so as to unlock a rotational movement of said wheel frame.

3. A roller skate shoe, as recited in claim 1, wherein said resilient member, which is a compression spring, is coaxially mounted on said operation button wherein said resilient element has one end biasing against said supporting member and an other end connected with a spring stopper for biasing against said sidewall of said receiving cavity, wherein said resilient member normally applies an urging force against said operation button to push it to said exterior of said shoe base through said operation through slot until said spring stopper is stopped by said sidewall of said receiving cavity so as to maintain said locking member in said locking position.

4. A roller skate shoe, as recited in claim 1, wherein said locker means further has a guiding slot provided on said supporting member of said supporting frame wherein said locking flange is fitted in said guiding slot so as to hold said locker cap in position.

5. A roller skate shoe, comprises:

a shoe base having two receiving cavities provided thereunder at a front portion and a rear portion of said shoe base respectively;

two roller arrangements, which are fittedly received in said receiving cavities, each comprising:

a supporting frame securely mounted on a ceiling of said receiving cavity comprising a supporting member extended downwardly, wherein said supporting member of said supporting frame comprises a pair of parallel walls extended downwardly from said ceiling of said receiving cavity;

a T-shaped wheel frame comprising a vertical wheel arm rotatably mounted on said supporting member of said supporting frame by a shaft and a horizontal wheel axle for rotatably supporting two wheels at two ends thereof, wherein said wheel arm of said wheel frame is rotatably mounted between said two supporting walls by said shaft; and a resilient element which is disposed in said wheel frame for applying an urging pressure against said wheel frame so as to normally retain said wheel frame slid out of the receiving cavity; and a locker means for securely locking said wheel frame in a rotatably movable manner selectively between a folded position and an unfolded position wherein in said folded position, said wheel frame is rotatably slid into said receiving cavity and in said unfolded position, said wheel frame is rotatably slid out of said receiving cavity, wherein said locker means has an operation through slot provided on a sidewall of said receiving cavity to communicate with an exterior of said shoe base, a locking member for selectively engaging with said wheel arm from being slid rotatably with respect to said supporting member, and a resilient member for applying an urging pressure against said locking member so as to retain said locking member engaging with said wheel arm, wherein said locking member comprises a locker cap coaxially attached to an outer end of said shaft and positioned adjacent to said respective supporting member wherein said locker cap comprises at least a locking flange integrally therefrom for selectively engaging with two locker grooves transversely formed on said wheel arm respectively, and an operation button extended to said operation through slot for operating said locker cap to move from a normally locking position to an unlocked position, wherein in said locking position, said locking flange is engaged with said locker grooves in said folded and unfolded positions of said wheel frame respectively, and in said unlocked position, said locking flange is disengaged with said locker groove so that said wheel frame is capably of rotatably sliding with respect to said supporting frame.

6. A roller skate shoe, as recited in claim 5, wherein said operation button comprises an elongated button body outwardly extended from an inner end of said shaft to said exterior of said shoe base through said operation through slot in slidably movable manner and an enlarged button head provided on an outer surface of said shoe base in such a manner that when said button head of said operation button is pressed in an inward manner, said locking flange of said locker cap is disengaged with said respective locker groove so as to unlock a rotational movement of said wheel frame.

7. A roller skate shoe, comprises:

a shoe base having two receiving cavities provided thereunder at a front portion and a rear portion of said shoe base respectively;

two roller arrangements, which are fittedly received in said receiving cavities, each comprising:

a supporting frame securely mounted on a ceiling of said receiving cavity comprising a supporting member extended downwardly, wherein said supporting member of said supporting frame comprises a pair of parallel walls extended downwardly from said ceiling of said receiving cavity;

a T-shaped wheel frame comprising a vertical wheel arm rotatably mounted on said supporting member of said supporting frame by a shaft and a horizontal wheel axle for rotatably supporting two wheels at two ends thereof, wherein said wheel arm of said wheel frame is rotatably mounted between said two supporting walls by said shaft; and a resilient element which is a coil spring disposed in said wheel frame for applying an urging pressure against said wheel frame for normally retaining and urging said wheel frame in said unfolded position so as to normally retain said wheel frame slid out of the receiving cavity, wherein said resilient element has a coil body coaxially affixed to said shaft and at least one resilient arm extended from said coil body for biasing against said wheel arm; and a locker means for securely locking said wheel frame in a rotatably movable manner selectively between a folded position and an unfolded position wherein in said folded position, said wheel frame is rotatably slid into said receiving cavity and in said unfolded position, said wheel frame is rotatably slid out of said receiving cavity, wherein said locker means has an operation through slot provided on a sidewall of said receiving cavity to communicate with an exterior of said shoe base, a locking member for selectively engaging with said wheel arm from being slid rotatably with respect to said supporting member, and a resilient member for applying an urging pressure against said locking member so as to retain said locking member engaging with said wheel arm, wherein said locking member comprises a locker cap coaxially attached to an outer end of said shaft and positioned adjacent to said respective supporting member wherein said locker cap comprises at least a locking flange integrally therefrom for selectively engaging with two locker grooves transversely formed on said wheel arm respectively, and an operation button extended to said operation through slot for operating said locker cap to move from a normally locking position to an unlocked position, wherein in said locking position, said locking flange is engaged with said locker grooves in said folded and unfolded positions of said wheel frame respectively, and in said unlocked position, said locking flange is disengaged with said locker groove so that said wheel frame is capably of rotatably sliding with respect to said supporting frame.

8. A roller skate shoe, as recited in claim 7, wherein said operation button comprises an elongated button body outwardly extended from an inner end of said shaft to said exterior of said shoe base through said operation through slot in slidably movable manner and an enlarged button head provided on an outer surface of said shoe base in such a manner that when said button head of said operation button is pressed in an inward manner, said locking flange of said locker cap is disengaged with said respective locker groove so as to unlock a rotational movement of said wheel frame.

9. A roller skate shoe, as recited in claim 7, wherein said resilient member, which is a compression spring, is coaxially mounted on said operation button wherein said resilient element has one end biasing against said supporting member and an other end connected with a spring stopper for biasing against said sidewall of said receiving cavity, wherein said resilient member normally applies an urging force against said operation button to push it to said exterior of said shoe base through said operation through slot until said spring stopper is stopped by said sidewall of said receiving cavity so as to maintain said locking member in said locking position.

10. A roller skate shoe, as recited in claim 8, wherein said resilient member, which is a compression spring, is coaxially mounted on said operation button wherein said resilient element has one end biasing against said supporting member and an other end connected with a spring stopper for biasing against said sidewall of said receiving cavity, wherein said resilient member normally applies an urging force against said operation button to push it to said exterior of said shoe base through said operation through slot until said spring stopper is stopped by said sidewall of said receiving cavity so as to maintain said locking member in said locking position.

11. A roller skate shoe, as recited in claim 7, wherein said locker means further has a guiding slot provided on said supporting member of said supporting frame wherein said locking flange is fitted in said guiding slot so as to hold said locker cap in position.

12. A roller skate shoe, as recited in claim 8, wherein said locker means further has a guiding slot provided on said supporting member of said supporting frame wherein said locking flange is fitted in said guiding slot so as to hold said locker cap in position.

13. A roller skate shoe, as recited in claim 10, wherein said locker means further has a guiding slot provided on said supporting member of said supporting frame wherein said locking flange is fitted in said guiding slot so as to hold said locker cap in position.

* * * * *